United States Patent [19]

Takushima et al.

[11] Patent Number: 5,076,070

[45] Date of Patent: Dec. 31, 1991

[54] FAN DEVICE FOR REFRIGERATOR

[75] Inventors: Akira Takushima, Yamato-Takada; Syozo Tanaka, Nara; Yoshiharu Shinobu, Kashihara; Masaki Eguchi, Kitakatsuragi, all of Japan

[73] Assignee: Sharp Kabushiki Kaisha, Osaka, Japan

[21] Appl. No.: 490,488

[22] Filed: Mar. 8, 1990

[30] Foreign Application Priority Data

Mar. 14, 1989 [JP] Japan ..... 1-61725

[51] Int. Cl.[5] ..... F25D 17/06

[52] U.S. Cl. ..... 62/426; 62/441; 415/119; 415/208.2; 415/223

[58] Field of Search ..... 415/208.1, 208.2, 208.3, 415/223, 182.1, 119; 62/404, 426, 441, 186

[56] References Cited

U.S. PATENT DOCUMENTS

| | | | |
|---|---|---|---|
| 882,477 | 3/1908 | Neumann | 415/208.3 |
| 3,090,209 | 5/1963 | Hubacker | 62/186 |
| 3,287,933 | 11/1966 | O'Connell et al. | 62/441 |
| 3,759,627 | 9/1973 | Ehlinger | 415/208.3 |
| 4,077,229 | 3/1978 | Gelbard et al. | 62/441 |
| 4,326,390 | 4/1982 | Brooks | 62/441 |
| 4,509,335 | 4/1985 | Griffin et al. | 62/441 |
| 4,620,833 | 11/1986 | Townsend | 415/208.3 |
| 4,768,353 | 9/1988 | Bushser | 62/441 |

FOREIGN PATENT DOCUMENTS

| | | | |
|---|---|---|---|
| 0116768 | 9/1979 | Japan | 62/441 |
| 0124364 | 9/1979 | Japan | 62/441 |
| 0145052 | 11/1979 | Japan | 62/441 |
| 0222178 | 9/1989 | Japan | 62/404 |

*Primary Examiner*—Edward K. Look
*Assistant Examiner*—Christopher M. Verdier
*Attorney, Agent, or Firm*—David G. Conlin; Donald Brown

[57] ABSTRACT

A fan device for a refrigerator includes a hollow wall having a front wall portion and a rear wall portion for dividing an interior space of the refrigerator into a heat exchanging zone and a first portion of a storage zone. An air suction opening is formed in the rear wall portion for allowing an air cooled in the heat exchanging zone to be induced into the hollow wall. A fan is disposed in alignment with the air suction opening so as to induce the cooled air. A plurality of forward air outlet slots are formed in the front wall portion for allowing the air in the hollow wall to be blown to the first portion of the storage zone. A rearward air outlet is formed in the rear wall portion for allowing the air in the hollow wall to be blown to a second portion of the storage zone through a duct communicating the rearward air outlet to the second portion.

2 Claims, 12 Drawing Sheets

FAN DEVICE FOR REFRIGERATOR

BACKGROUND OF THE INVENTION

1. Field of the Invention

The present invention relates to a fan device mounted in a refrigerator.

2. Description of the Related Art

In general, a refrigerator has a fan device which is mounted in an upper rear portion of the space inside the refrigerator for the purpose of supplying cold air into a freezing room and a refrigerating room.

Such a fan device has a hollow wall composed of a fan louver forming a front wall and an evaporator cover forming a rear wall. An air suction opening is formed substantially in the center of the evaporator cover, and a fan having an axial-flow blower is disposed in alignment with the suction opening and held by a motor cover. The fan induces cold air behind the hollow wall into the hollow wall. The fan louver has a plurality of forward air outlet slots which are substantially equally distributed upward and downward and to the left and right so as to uniformly distribute the cold air forwardly therethrough from the hollow wall into the freezing room. The evaporator cover has also a rearward air outlet for rearwardly discharging air from the hollow wall. The rearward air outlet is offset to the left or right from the air suction opening for a reason concerning the construction of the refrigerator. A fan duct is connected to the rearward air outlet so that the cold air in the hollow wall is blown into the refrigerating room through this fan duct.

A returning duct is formed on the rear side of the freezing room and the refrigerating room. The air blown through the forward air outlet slots into the freezing room cools the freezing room and then flows into the returning duct. The air blown into the refrigerating room though the rearward air outlet and the fan duct cools the refrigerating room and then flows into the returning duct.

The air collected in the returning duct is induced upward by the fan through a heat exchanger in a refrigeration cycle so as to be cooled and the cooled air is again blown into the hollow wall by the fan. The share or distribution of air to the forward and rearward air outlets, as well as layout of these air outlets, is determined in accordance with the results of test operations of the refrigerator.

The forward air outlet slots open uniformly to the left and right and upward and downward by the design of the fan louver. However, the rearward air outlet is located on the left or right side of the central air suction opening so that a difference is caused in the flow resistance to the air between the left and right portions of the fan louver which is provided with the forward air outlet slots, so that the flow of air tends to be concentrated to a local portion of the forward air outlet slots. Furthermore, since the motor cover is provided on the upper side of the fan, air does not flow toward the fan from the upper side thereof. In addition, the fan duct provided on the left or right side of the fan interrupts the flow of air flowing into the fan. In consequence, the fan induces air mainly from the left or right lower rear quarter of the fan.

When the fan induces air from, for example, left lower rear quarter thereof, the fan discharges the air to the right front upper quarter thereof. If the fan can perform its expected function, a spiral flow of air with no disturbance would be formed along the axis of the fan. Actually, however, the flow of air discharged from the fan is undesirably offset to the right side. This also causes an offset in the fluid dynamical force acting on each fan blade, resulting in a reduction of efficiency of the fan, as well as a generation of noise.

The air strongly blown to the right, upper front side of the fan tends to flow towards the rearward air outlet along an arcuate path so as to collide with air which flows to the right along the upper edge of the evaporator cover from the left upper side of the fan. It is therefore impossible to efficiently introduce the air from the fan towards the rearward air outlet. Since the blowing of air through the rearward air outlet is hampered, the air blown by the fan tends to directly reach the forward air outlet slots so that the noise generated by the fan propagates forwardly through the forward air outlet slots.

In addition, collision of flows of air flowing in different directions occur at the right side of the fan so as to cause a loss, with the result that the air blowing efficiency is further decreased.

SUMMARY OF THE INVENTION

Accordingly, an object of the present invention is to provide a fan device for a refrigerator which exhibits a high air-blowing efficiency while reducing the level of noise.

According to the present invention, the object can be achieved by a first fan device for a refrigerator. The first fan device includes: a hollow wall having a front wall portion and a rear wall portion for dividing an interior space of the refrigerator into a heat exchanging zone and a first portion of a storage zone; an air suction opening formed in the rear wall portion for allowing an air cooled in the heat exchanging zone to be induced into the hollow wall; a fan disposed in alignment with the air suction opening so as to induce the cooled air; a plurality of forward air outlet slots formed in the front wall portion for allowing the air in the hollow wall to be blown to the first portion of the storage zone; a rearward air outlet formed in the rear wall portion for allowing the air in the hollow wall to be blown to a second portion of the storage zone through a duct communicating the rearward air outlet to the second portion; and a tubular member surrounding the fan in parallel with a rotational axis of the fan and extending rearwardly from the air suction opening for forming a flow of air therethrough toward the fan substantially parallel with the rotational axis.

In the first fan device of the present invention, the tubular member surrounds the fan in parallel with the rotational axis and extends rearwardly from the air suction opening for forming the flow of the air therethrough toward the fan substantially parallel with the rotational axis. Accordingly, fan blades receive a substantially constant load regardless of the rotational position, so that the fan can perform its expected function to generate a spiral flow of air along the rotational axis without turbulency, thus improving the air blowing efficiency and reducing noise.

According to the present invention, the object can be also achieved by a second fan device for a refrigerator. The second fan device includes: a hollow wall having a front wall portion and a rear wall portion for dividing an interior space of the refrigerator into a heat exchanging zone and a first portion of a storage zone; an air suction opening formed in the rear wall portion for allowing an air cooled in the heat exchanging zone to be induced into the hollow wall; a fan disposed in alignment with the air suction opening so as to induce the cooled air; a plurality of forward air outlet slots formed in the front wall portion for allowing the air in the hollow wall to be blown to the first portion of the storage zone; a rearward air outlet formed in the rear wall portion at a side of the air suction opening for allowing the air in the hollow wall to be blown to a second portion of the storage zone through a duct communicating the rearward air outlet to the second portion; and at least one flow settling plate disposed in the hollow wall at a position above the air suction opening so as to separate a first air flow component and a second air flow component, the first air flow component being blown upwardly from the fan and directed toward the rearward air outlet, the second air flow component flowing along an upper edge of the hollow wall toward the rearward air outlet.

In the second fan device of the present invention, at least one flow settling plate is disposed in the hollow wall at a position above the air suction opening so as to separate the first air flow component and the second air flow component. The first air flow component is blown upwardly from the fan and directed toward the rearward air outlet, while the second air flow component flows along the upper edge of the hollow wall toward the rearward air outlet. Accordingly, the air is efficiently blown by the fan to the rearward air outlet so as to ensure a smooth discharge of the air from the rearward outlet. Thus, the air blown by the fan is prevented from directly reaching the forward air outlet slots and, hence, the noise generated by the fan from propagating forwardly through the forward air outlet slots.

According to the present invention, the object can be also achieved by a third fan device for a refrigerator. The third fan device includes: a fan device for a refrigerator comprising: a hollow wall having a front wall portion and a rear wall portion for dividing an interior space of the refrigerator into a heat exchanging zone and a first portion of a storage zone; an air suction opening formed in the rear wall portion for allowing an air cooled in the heat exchanging zone to be induced into the hollow wall; a fan disposed in alignment with the air suction opening so as to induce the cooled air; a plurality of forward air outlet slots formed in the front wall portion for allowing the air in the hollow wall to be blown to the first portion of the storage zone; a rearward air outlet formed in the rear wall portion at a side of the air suction opening for allowing the air in the hollow wall to be blown to a second portion of the storage zone through a duct communicating the rearward air outlet to the second portion; and a flow settling plate disposed in the hollow wall at a position between the air suction opening and the rearward air outlet so as to separate a first air flow component and a second air flow component, the first air flow component being blown upward from the fan and directed laterally toward the rearward air outlet, the second air flow component being a circulation flow generated below the rearward air outlet and flowing adjacent to the first air flow component in a direction opposed to the flowing direction of the first air flow component.

In the third fan device of the present invention, a flow settling plate is disposed in the hollow wall at a position between the air suction opening and the rearward air outlet so as to separate a first air flow component and a second air flow component. The first air flow component is blown upwardly from the fan and directed laterally toward the rearward air outlet, while the second air flow component is a circulation flow generated below the rearward air outlet and flowing adjacent to the first air flow component in the direction opposed to the flowing direction of the first air flow component. Here, this first air flow component in the third fan device coincides with the first air flow component in the aforementioned second fan device of the present invention. Accordingly, noise and loss, which would occur by a collision between the first air flow component and the second air flow component without the flow settling plate, are prevented, thus improving the air blowing efficiency of the fan and reducing noise.

DESCRIPTION OF THE PREFERRED EMBODIMENTS

Preferred embodiments of the present invention will be described with reference to the accompanying drawings.

Figure 1:
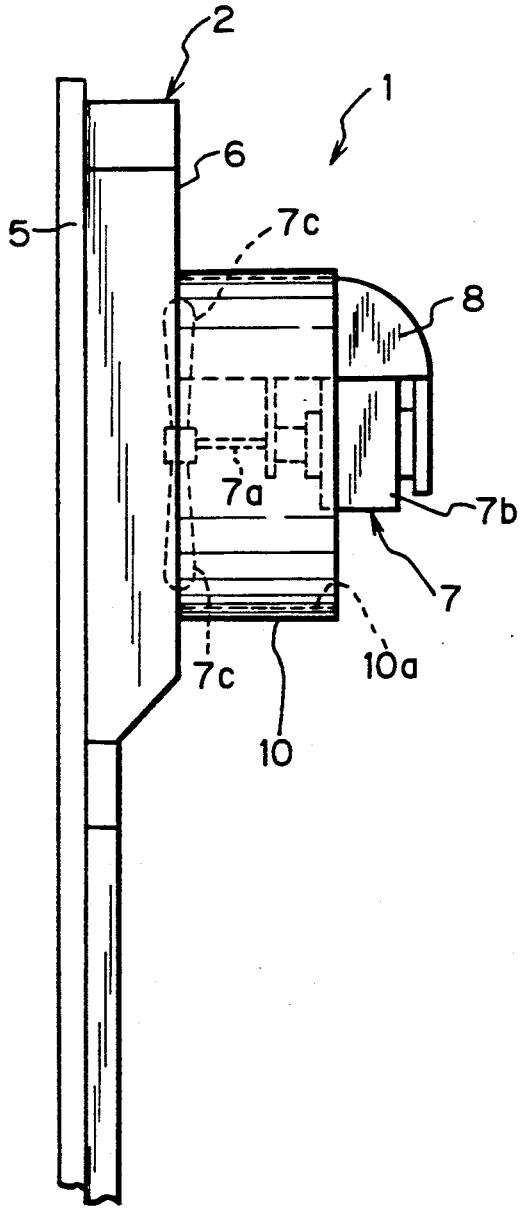
FIG. 1 is a side elevational view of a first embodiment of the present invention.
Figure 2:
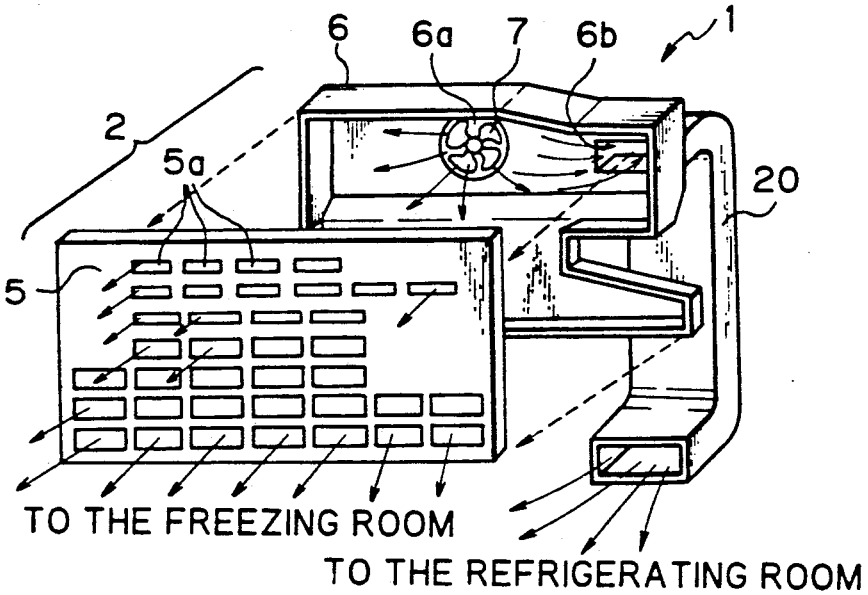
FIG. 2 is an exploded perspective view of the first embodiment as viewed from the front side thereof.
Figure 3:
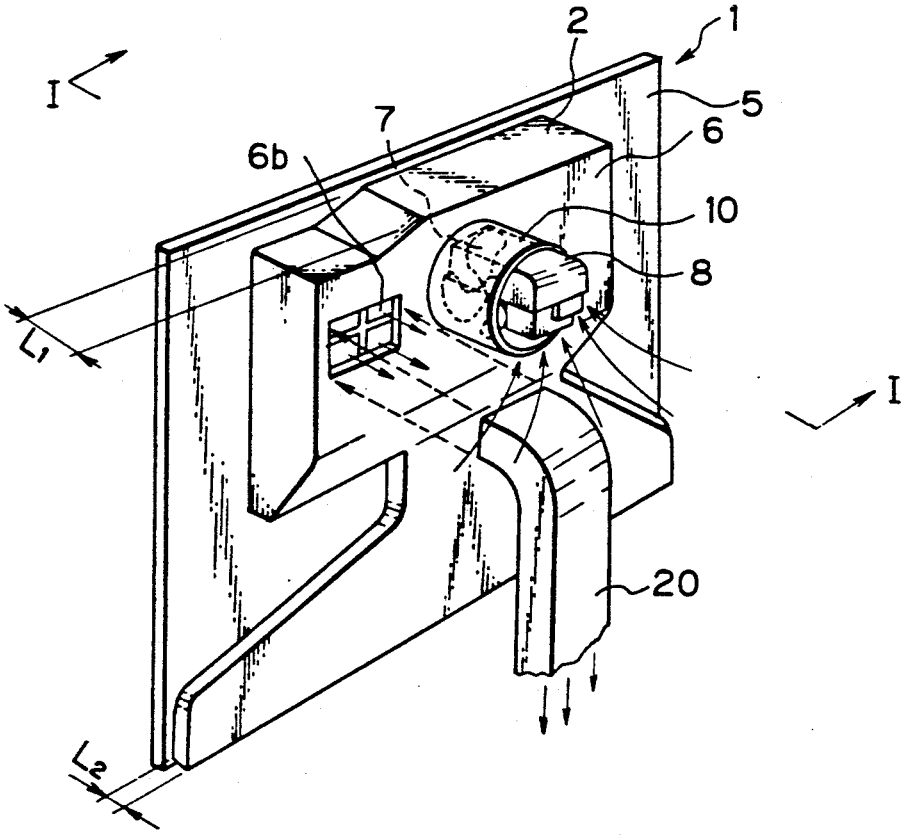
FIG. 3 is an exploded perspective view of the first embodiment as viewed from the rear side thereof.

FIG. 1 is a side elevational view of the first embodiment of a fan device for a refrigerator of the present invention, while FIGS. 2 and 3 are exploded perspective views of the first embodiment as viewed from the front and rear sides of the same.

As will be seen from these Figures, the fan device 1 has a hollow wall 2 which is composed of a fan louver 5 forming a front wall portion and an evaporator cover 6 forming a rear wall portion. The fan device 1 also has a fan 7 which is an axial-flow blower mounted in alignment with a circular air suction opening 6a formed substantially at the center of the evaporator cover 6.

As will be seen from FIGS. 1 and 3, the fan 7 has a motor unit 7b which is held by the motor cover 8 fixed to an upper side of the air suction opening 6a, whereby the fan 7 is secured to the rear side of the evaporator cover 6.

Referring specifically to FIG. 3, the portion of the evaporator cover 6 including the air suction opening 6a has a comparatively large thickness or depth $L_1$ of, for example, about 30 mm, whereas other portion of the evaporator cover 6 has a comparatively small thickness or depth $L_2$ of, for example, about 10 mm.

As will be seen from FIG. 2, the fan louver 5 has a plurality of forward air outlet slots 5a each of which has a substantially rectangular shape and which are uniformly distributed both in lateral directions and vertical directions for frontwardly discharging the air from the hollow wall 2.

The deeper portion of the evaporator cover 6 has, as shown in FIGS. 2 and 3, a rearward air outlet 6b for rearwardly discharging the air from the hollow wall 2. The rearward air outlet 6b is disposed on the right side of the air suction opening 6a. A fan duct 20, which is to be connected to the rearward air outlet 6b, is also shown in FIGS. 2 and 3.

Referring now to FIGS. 1 and 3, a cylindrical air guide tube 10, for example of 50 mm long, is disposed on the rear side of the evaporator cover 6 so as to extend over and surround the air suction opening 6a, the fan 7 and the motor cover 8. The air guide tube 10 is opened at its rear end 10a so as to allow the air to be sucked only through the open rear end 10a and generate a flow of the air toward the fan 7 substantially in the same direction as a rotational shaft 7a of the fan 7.

Figure 4:
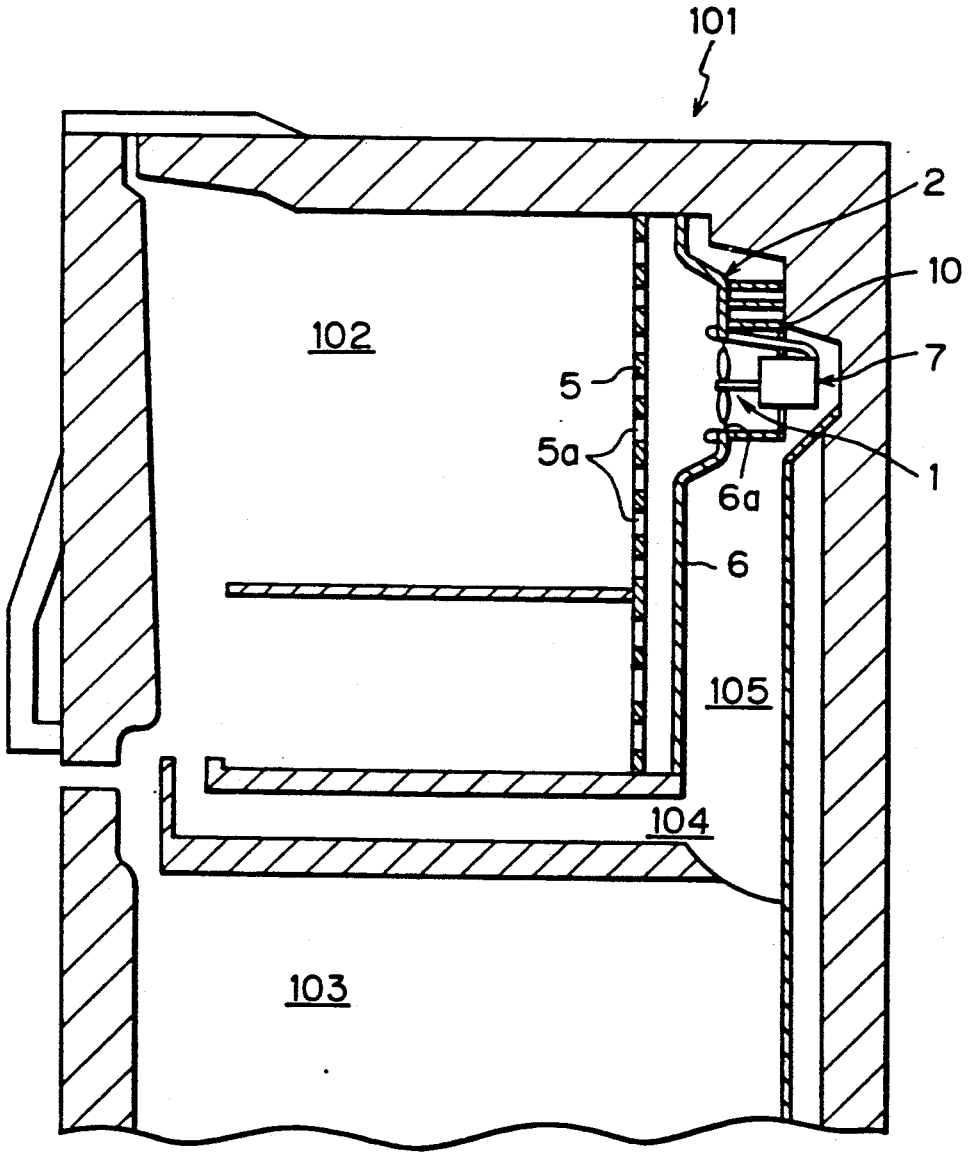
FIG. 4 is a sectional view of a refrigerator incorporating the first embodiment.

FIG. 4 illustrates a refrigerator 101 which incorporates the fan device 1 having the described construction. As will be seen from this Figure, the refrigerator 101 has a freezing room 102 and a refrigerating room 103. The fan device 1 is disposed on the rear side of the freezing room 102. The freezing room 102 is separated by the hollow wall 2 from a heat-exchanging zone 105 in which a heat exchanger, i.e., an evaporator (not shown), is disposed.

In operation, the fan device 1 induces cooled air from the heat exchanging zone 105 into the hollow wall 2 by means of the fan 7 and discharges the cooled air from the hollow wall 2 into the freezing room 102 through the air outlet slots 5a. At the same time, the fan device 1 induces the cooled air from the hollow wall 2 into the refrigerating room 103 through the rearward air outlet 6b and then through the fan duct 20.

The air after cooling the spaces in the freezing room 102 and the refrigerating room 103 is finally collected in a returning duct 104. The air collected in the duct 104 flows upward towards the fan 7 past the heat-exchanging zone 105 so as to be cooled by the heat exchanger. Then thus cooled air is sucked by the fan 7 again and the same cycle as described above is repeated during the operation.

By virtue of the air guide tube 10, the flow of the sucked air is generated to flow towards the fan 7 in the substantially same direction as the rotational shaft 7a, thus enabling the fan 7 to fully exert its performance. In consequence, all blades 7c of the fan 7 are enabled to work efficiently and loaded uniformly regardless of their rotational positions.

Figure 5:
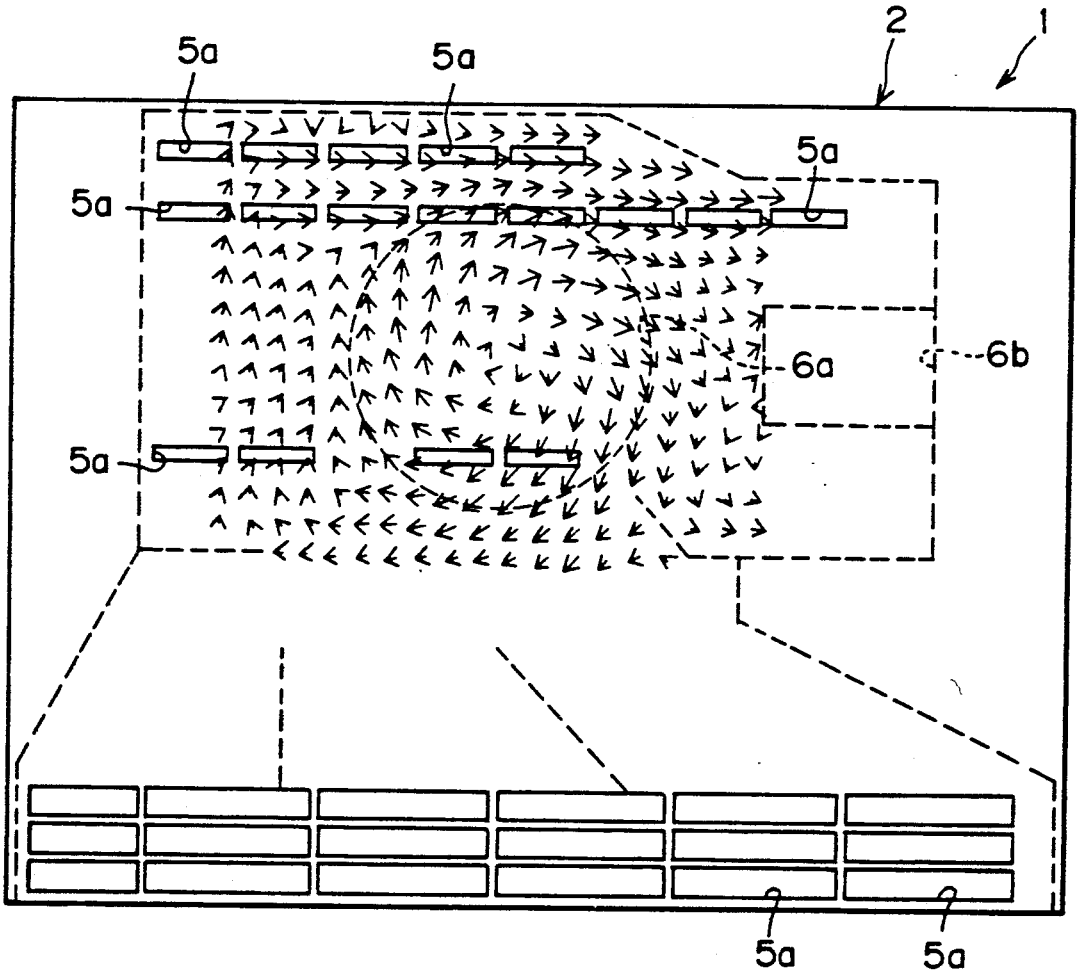
FIG. 5 is a front elevational view of the first embodiment, showing also two-dimensional flow velocity distribution at a position which is 18 mm spaced from a fan louver.
Figure 6:
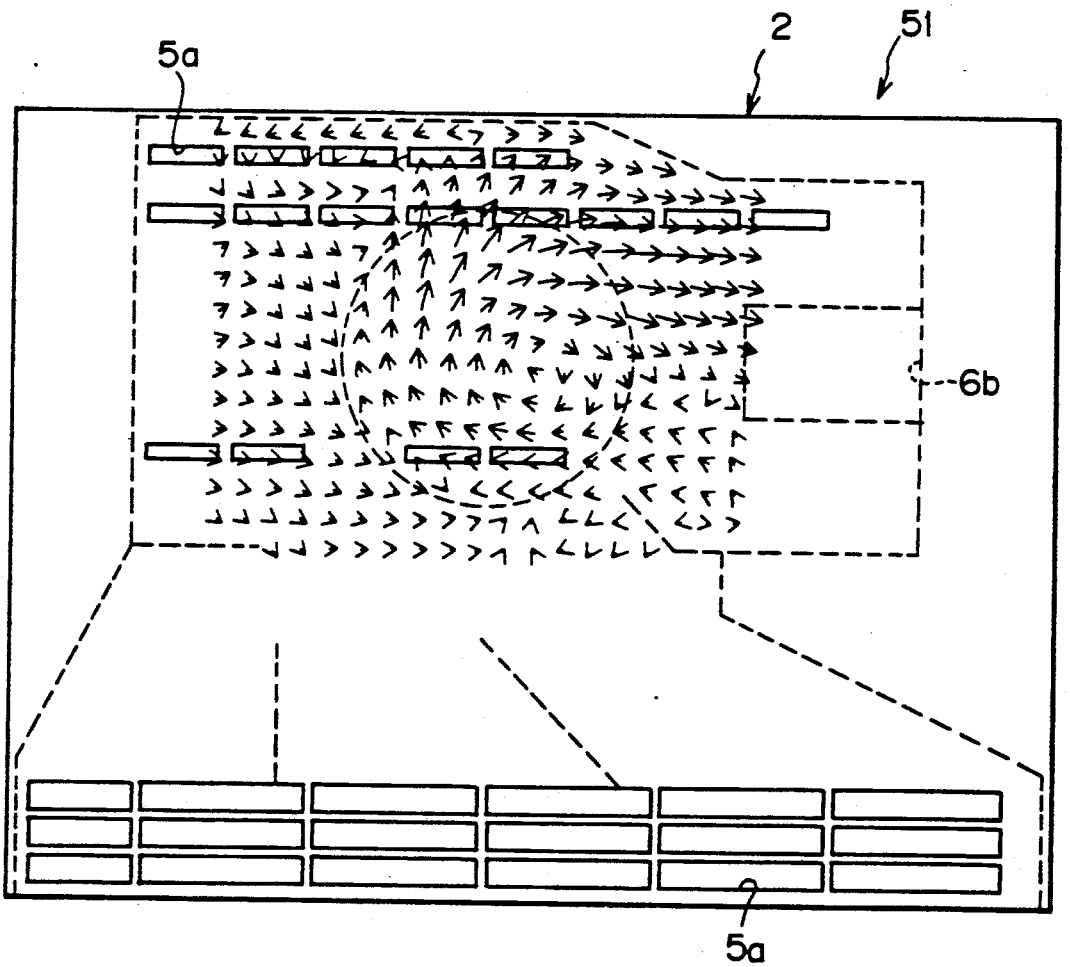
FIG. 6 is a front elevational view of a comparison example, showing also two-dimensional flow velocity distribution at a position which is 18 mm spaced from a fan louver.
Figure 7:
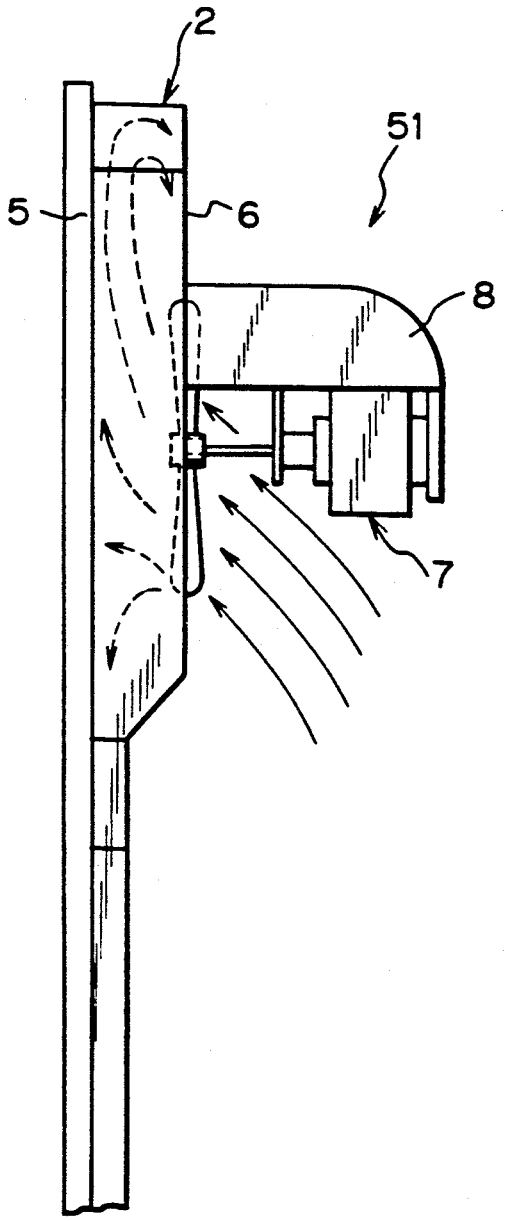
FIG. 7 is a side elevational view of the comparison example shown in FIG. 6.

FIG. 5 shows the first embodiment in front elevation, as well as two-dimensional flow velocity distribution of the air as observed at a point which is 18 mm spaced from the fan louver 5 towards the evaporator cover 6, while FIG. 6 is a front elevational view of a fan device 51 of a comparison example which is devoid of the air guide tube 10, together with the two-dimensional flow velocity distribution as observed at a point 18 mm spaced from the fan louver 5 towards the evaporator cover 6. FIG. 7 is a side elevational view of this fan device 51 of the comparison example showing the pattern of flow of the air. In FIGS. 5 and 6, flow directions of air are indicated by arrows the lengths of which correspond to the flowing velocities.

As will be seen from FIG. 5, the first embodiment enables the formation of a spiral flow of air along the axis of the fan 7 without turbulency, by virtue of provision of the air guide tube 10, thereby improving air blowing efficiency and reducing the noise level.

In the comparison example of fan device 51 which is devoid of the air guide tube 10, air is induced from the left, lower rear quarter of the fan 7 and is discharged toward the right, upper front quarter of the fan 7, as shown in FIGS. 6 and 7. In consequence, the flow of air discharged from the fan louver 5 is offset to the right, failing to form a non-turbulent spiral flow along the axis of the fan 7.

The air guide tube 10 does not substantially complicate the construction of the fan device 1 so that no difficulty is encountered with its assembly.

In the first embodiment as described, the air guide tube 10 has a length of 50 mm. This length value, however, is only illustrative and greater or smaller lengths can be employed provided that the air guide tube 10 can generate a flow of sucked air substantially in the same direction as the shaft 7a. The air guide tube 10 can also have any suitable polygonal tubular form, although a cylindrical air guide tube 10 is specifically mentioned. When the air guide tube 10 has a cylindrical form, it is not always necessary that the air guide tube 10 is coaxial with the fan. When a polygonal air guide tube is used, one side of the open end of the tube may contact with the air suction opening 6a. Thus, the specifications concerning the air guide tube 10 are suitably determined in accordance with various factors such as the numbers and shapes of the air outlet slots 5a and the rearward air outlet 6b, the operation speed of the fan 7 and other factors.

Figure 8:
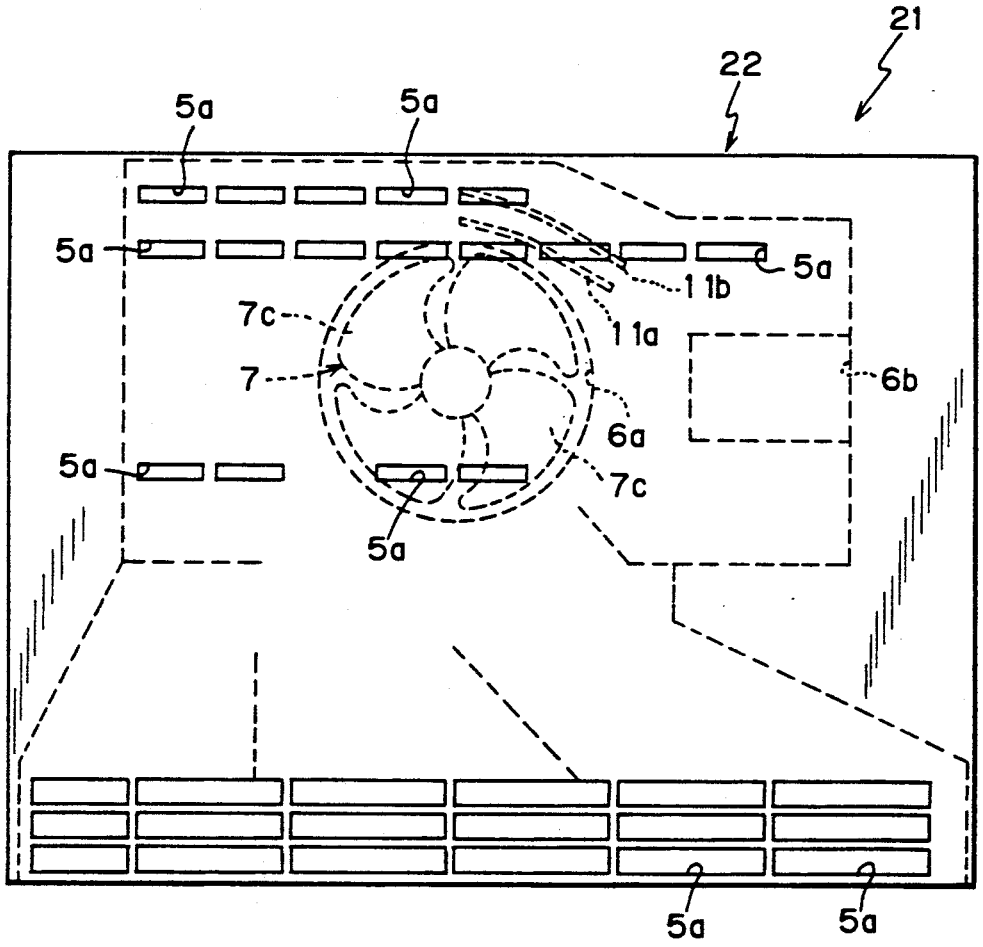
FIG. 8 is a front elevational view of a second embodiment of the present invention.

FIG. 8 shows a second embodiment of the present invention in front elevation. In this Figure, the same reference numerals are used to denote the same elements as those used in the first embodiment, and explanations thereof are omitted.

In FIG. 8, the second embodiment of the fan device 21 for a refrigerator has a pair of flow settling plates 11a and 11b which are disposed in the space within the hollow wall 22 above the fan 7 such that they extend in parallel with each other at a spacing of 10 mm from each other and that they are progressively spaced apart from the fan 7.

Each of the flow settling plates 11a and 11b is fixed to the evaporator cover 6 and projects towards the fan louver 5 by a height of 12 mm, so that the tip end surfaces of the flow settling plates 11a and 11b are 18 mm spaced from the inner surface of the fan louver 5. The flow settling plate 11a adjacent to the fan 7 includes an arcuate portion, which extends over an angle of 30° from the position right above the air suction opening 6a at a radius which is 10 mm longer than that of the air suction opening 6a, and a linear portion of 30 mm long, which extends from the end of the arcuate portion towards the rearward air outlet 6b.

The other flow settling plate 11b has a similar shape of the flow settling plate 11a, including an arcuate portion and a linear portion.

Thus, the flow settling plates 11a and 11b have a function to separate a first air flow component, which is discharged upward from the fan 7 and directed toward the rear air outlet 6b, and a second air flow component, which flows towards the rearward air outlet 6b along the upper edge of the hollow wall 2.

According to the described arrangement, it is possible to prevent collision of these two air flow components, so that the air blown by the fan 7 can be efficiently introduced towards the rearward air outlet 6b.

Figure 9:
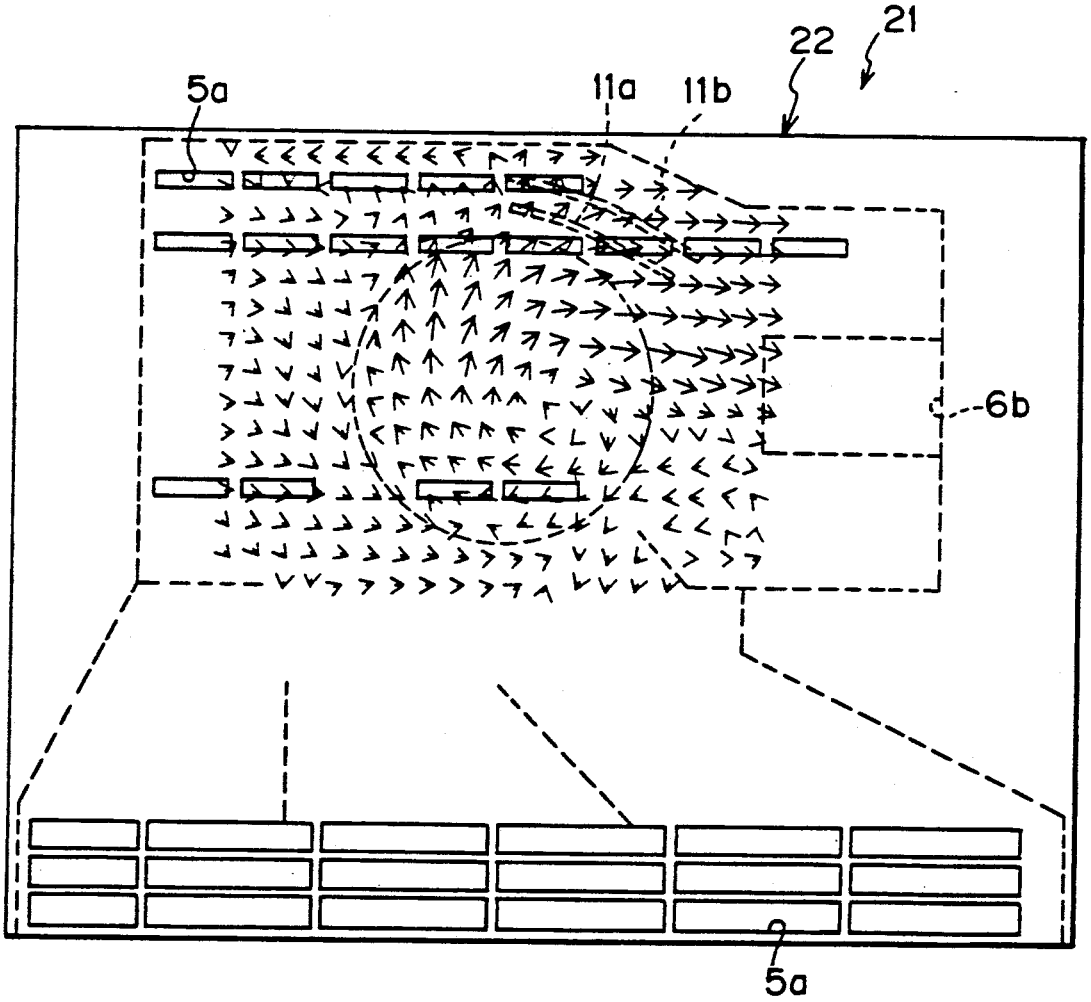
FIG. 9 is a front elevational view of the second embodiment, showing also two-dimensional flow velocity distribution at a position which is 18 mm spaced from a fan louver.

FIG. 9 illustrates the manner of the air discharged by the fan 7 in the hollow wall 22, i.e., two-dimensional flow velocity distribution at a position which is 18 mm spaced apart from the fan louver 5 towards the evaporator cover 6, i.e., at the tip end surfaces of the flow settling plates 11a and 11b.

From FIG. 9, it will be seen that the above-mentioned collision and, hence, wasteful mixing of flow components, are avoided so as to eliminate any undesirable effect on the total blowing performance of the fan device 21 without substantially changing the overall flow pattern of the air.

In consequence, the delivery of the air through the rearward air outlet 6b is conducted with reduced resistance so as to prevent the air discharged by the fan 7 from directly reaching the air outlet slots 5a, thus preventing noise generated by the fan 7 from propagating forwardly through the air outlet slots 5a.

Figure 10:
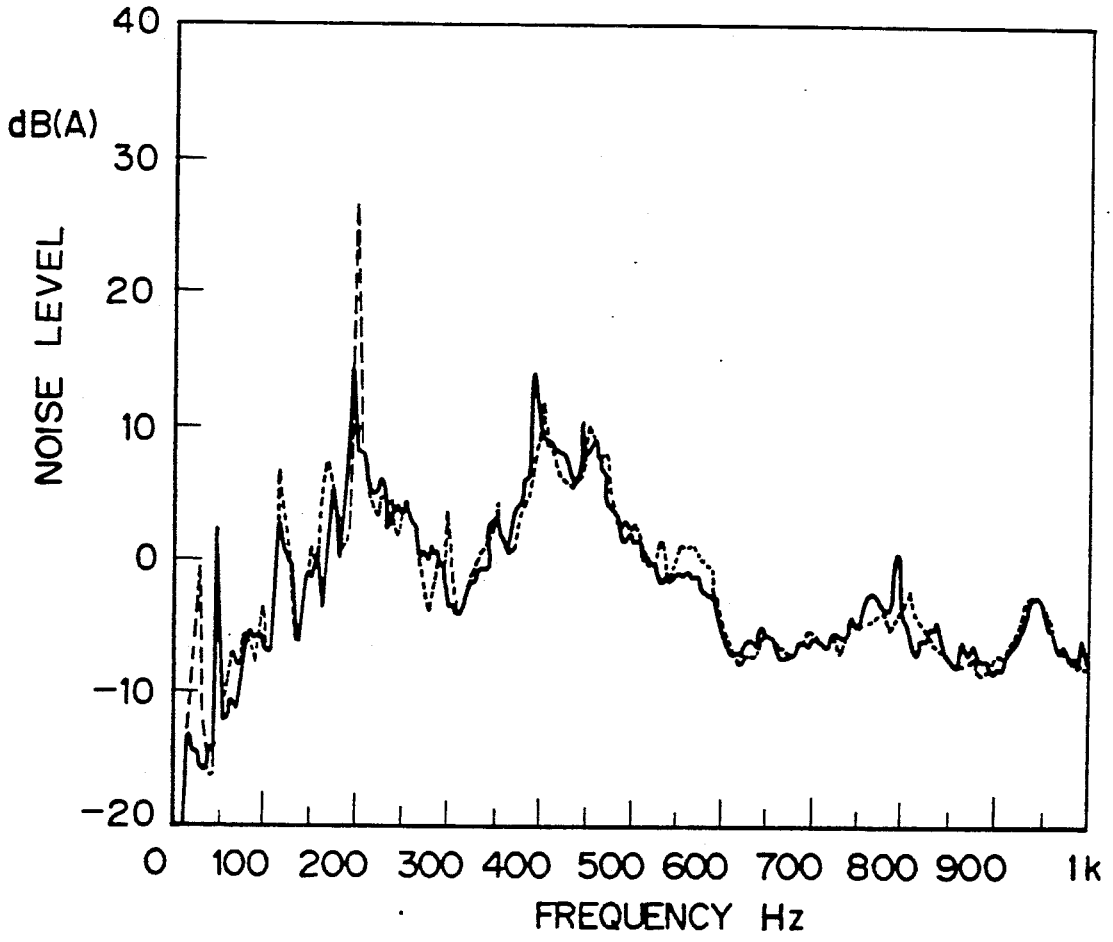
FIG. 10 is a graph showing a relationship between frequency and noise level.

FIG. 10 shows the result of analysis of noise generated by the fan device 21, as well as that in a comparison example which is devoid of the flow settling plates 11a and 11b. The noise characteristic of the fan device 21 and that of the comparison example are respectively shown by a solid-line curve and a broken-line curve. As will be seen from this Figure, the fan device 21 exhibits a remarkable reduction of noise particularly in a frequency range around 200 Hz which is attributable to the operation of the fan 7. The amount of reduction of the noise at this range is as large as 13.5 dB (A).

Although the second embodiment as described above incorporates a pair of flow settling plates 11a and 11b, it is possible to provide only one or more than two of flow settling plates. It is also possible to elongate the length of the flow settling plate such that these plates contact with the air suction opening 6a or the rearward air outlet 6b. Furthermore, the projecting amount of the flow settling plate or plates may be varied within a predetermined range. The detailed specifications of the flow setting plates 11a and 11b are therefore suitably set in accordance with the factors such as the number and shapes of the air outlet slots 5a or the rearward air outlet 6b, the operation speed of the fan 7 and so forth.

Figure 11:
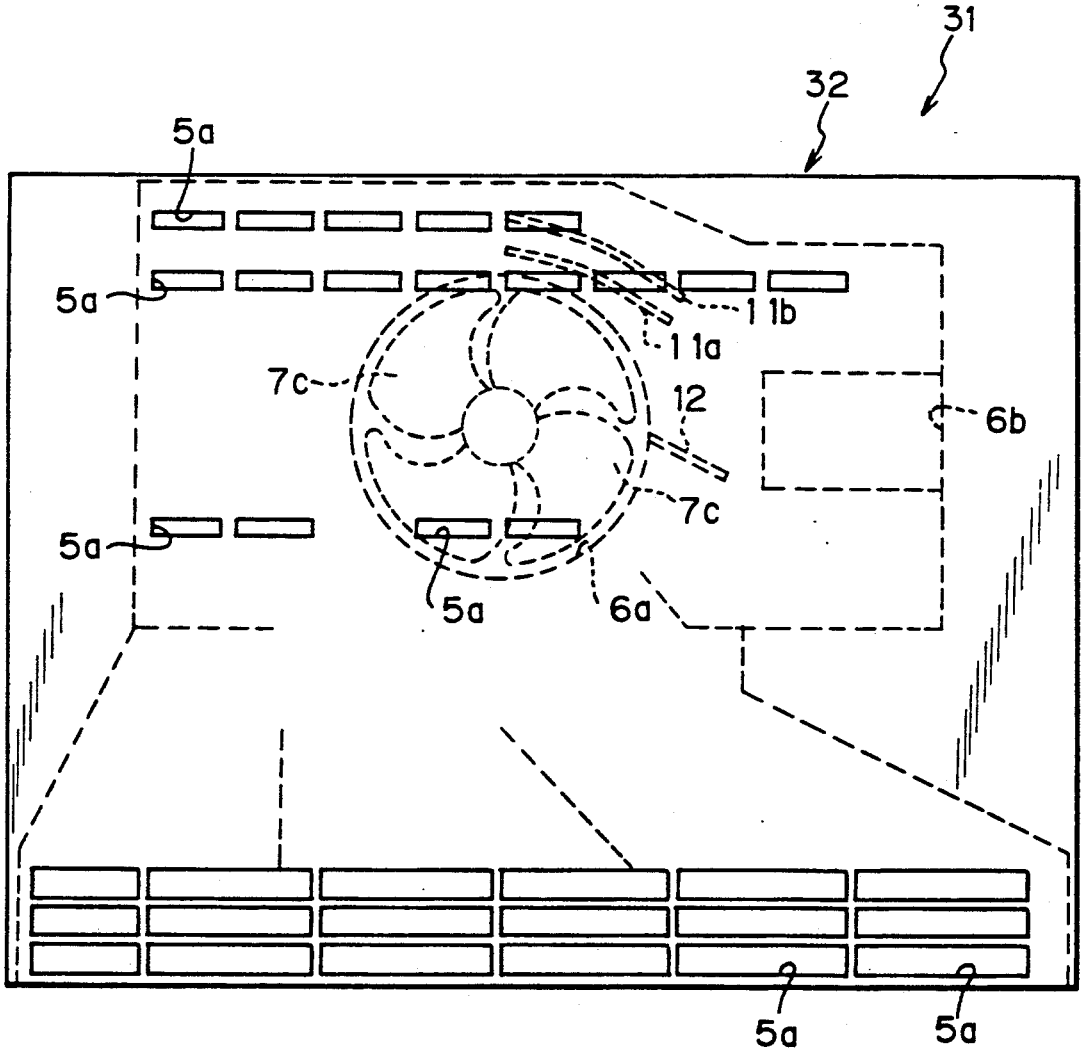
FIG. 11 is a front elevational view of a third embodiment.

FIG. 11 is a front elevational view of a third embodiment. In this Figure, the same reference numerals are used to denote the same elements as those of the first and second embodiments, and explanations thereof are omitted.

The third embodiment of the fan device 31 has, as shown in FIG. 11, a flow settling plate 12 in addition to the flow settling plates 11a, 11b used in the second embodiment.

The flow settling plate 12 is disposed within the hollow wall 32 on the right side of the fan 7 so as to cooperate with the flow settling plate 11a in defining therebetween a passage.

The flow settling plate 12 is fixed to the evaporator cover 6 and projects towards the fan louver 5 by an amount of 15 mm, for example. Thus, the tip end surface of the flow settling plate 12 is 15 mm spaced apart from the inner surface of the fan louver 5.

As will be seen from FIG. 12, the flow settling plate 12 is provided so as to extend from a portion of the peripheral edge of the air suction opening 6a to a point near the rearward air outlet 6b, along the boundary between the first air flow component as mentioned above and a third air flow component, adjacent to the first air flow component, which is a circulation flow generated below the rearward air outlet 6b, so as to separate these two air flow components from each other.

According to the above-described arrangement, both flow components are prevented from contacting each other so that the loss which may otherwise occur as a result of such a contact is eliminated to enable improvement in the air blowing efficiency of the fan 7. FIG. 12 shows two-dimensional flow velocity distribution at a point which is 18 mm spaced apart from the fan louver 5 towards the evaporator cover 6, i.e., at a position which is about 3 mm spaced from the tip end surface of the flow settling plate 12 toward the evaporator cover 6. Similarly, FIG. 13 illustrates two-dimensional velocity distribution at a point which is about 24 mm spaced from the fan louver 5 toward the evaporator cover 6, i.e., at a plane which is substantially midst between the tip end surfaces of the flow settling plates 11a, 11b and the evaporator cover 6.

Figure 12:
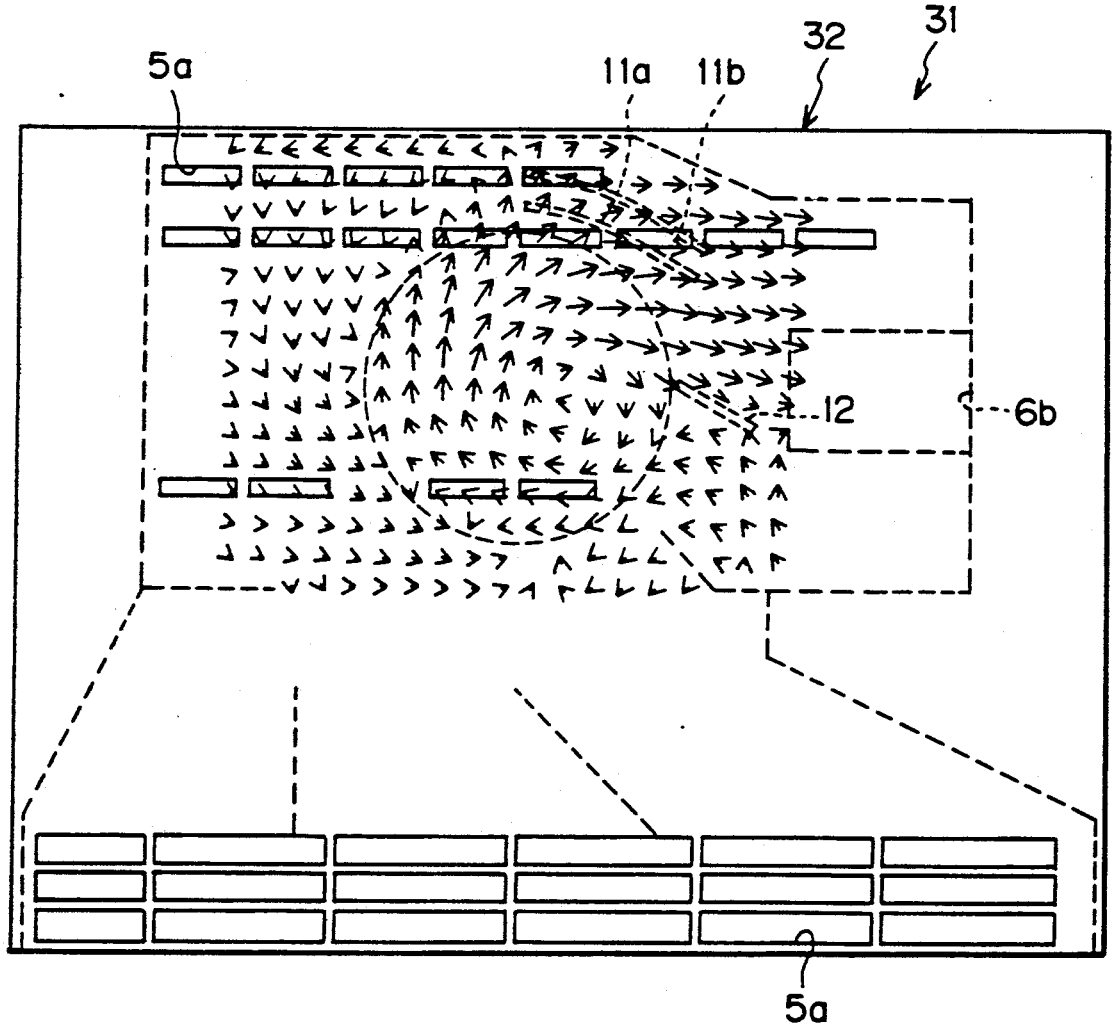
FIG. 12 is a front elevational view of the second embodiment, showing also two-dimensional flow velocity distribution at a position which is 18 mm spaced from a fan louver.
Figure 13:
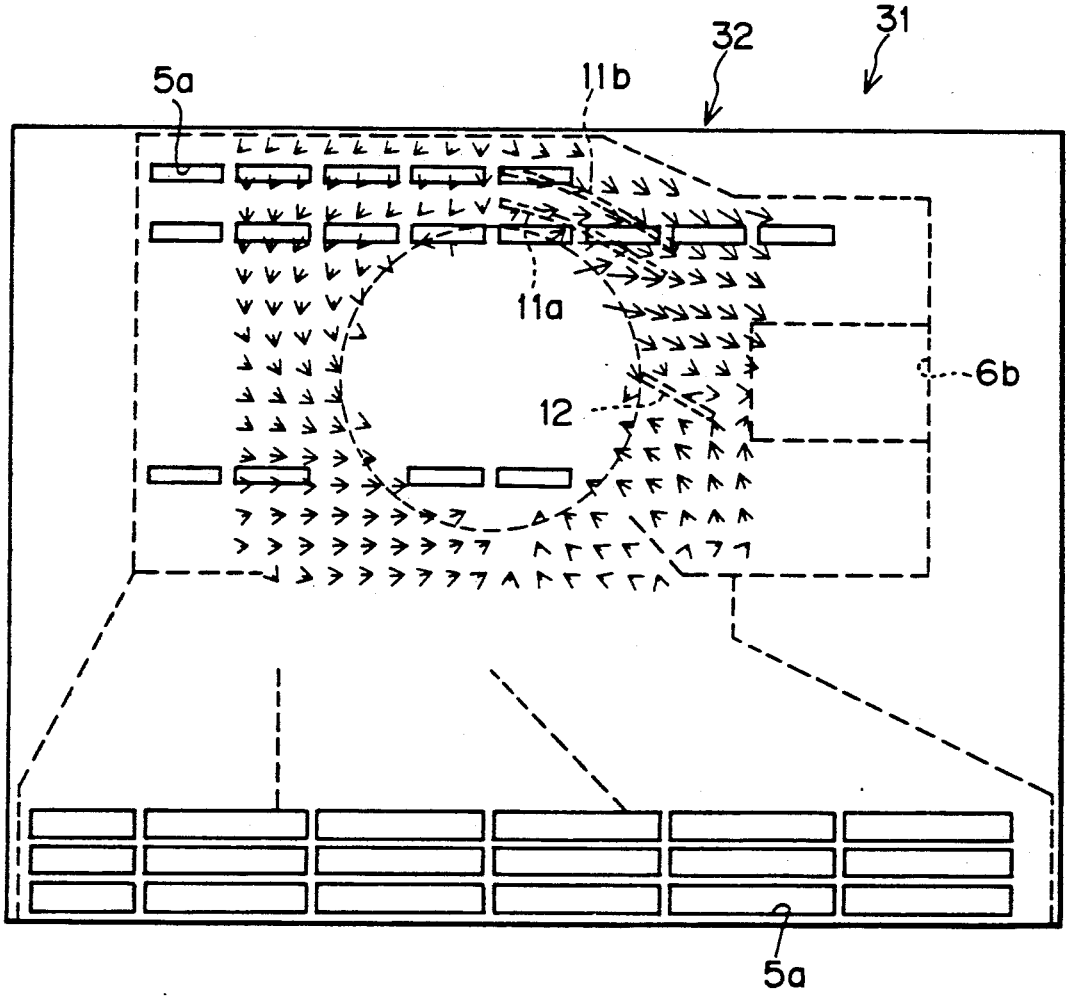
FIG. 13 is a front elevational view of the second embodiment, showing also two-dimensional flow velocity distribution at a position which is 24 mm spaced from a fan louver.

As is clear from FIGS. 12 and 13, the flow settling plate 12 produces the above-described effect so that the air from the fan 7 is smoothly directed toward the rearward air outlet 6b.

In the third embodiment as described, the flow settling plate 12 cooperates with the flow settling plate 11a in defining therebetween an air passage so that the flow of the air is further smoothed.

The projection amount and length of the flow settling plate 12 also are variable within predetermined range. The detailed specifications of the flow settling plates 12 are therefore suitably set in accordance with the factors such as the number and shapes of the air outlet slots 5a or the rearward air outlet 6b, the operation speed of the fan 7 and so forth.

As has been described, in the first embodiment of the present invention, the spiral flow of the sucked air without turbulency is formed along the axis of the fan 7 so as to improve the air blowing efficiency of the fan 7 while reducing the level of noise, by virtue of the provision of the air guide tube 10 which extend over and surround the air suction opening and the fan 7 so as to generate the flow of sucked air substantially parallel to the shaft of the fan 7.

The second embodiment as described has the flow settling plates 11a, 11b which are disposed inside the hollow wall 22 at the position above the fan 7 in such a manner as to separate the first air flow component, which is directed upward from the fan 7 toward the rearward air outlet 6b, and the second flow component, which is directed toward the rearward air outlet 6b along the upper edge of the hollow wall 22, so that the air is smoothly blown from the rearward air outlet 6b and prevents the air discharged by the fan 7 from directly reaching the air outlet slots 5*a* and thus prevents the noise produced by the fan 7 from forwardly propagating through the air outlet slots 5*a*. In addition, the air blowing efficiency of the fan 7 is improved remarkably.

In the third embodiment as described, the flow settling plate 12, which is disposed in the hollow wall 32 in a region between the air suction opening 6*a* and the rearward air outlet 6*b*, effectively separates the first air flow component, which is discharged laterally from the fan 7 and directed towards the rearward air outlet 6*b*, from the adjacent third air flow component, which is counter to the first air flow component. Consequently, the flow settling plate 12 prevents the mutual contact of both flow components so as to eliminate any loss which may otherwise occur due to such a contact, thus improving the air blowing efficiency of the fan 7 and reducing the level of the noise propagated from the fan 7.

What is claimed is:

1. A fan device for a refrigerator comprising:

a hollow wall having a front wall portion and a rear wall portion for dividing an interior space of said refrigerator into a heat exchange zone and a first portion of a storage zone;

an air suction opening formed in said rear wall portion for allowing an air cooled in said heat exchanging zone to be induced into said hollow wall;

a fan disposed in alignment with said air suction opening so as to induce said cooled air;

a plurality of forward air outlet slots formed in said front wall portion for allowing said air in said hollow wall to be blown to said first portion; and a rearward air outlet formed in said rear wall portion at a side of said air suction opening for allowing said air in said hollow wall to be blown to a second portion of said storage zone through means for communicating said rearward air outlet to said second portion;

wherein at least one flow settling plate is disposed in said hollow wall at a position above said air suction opening so as to separate a first air flow component and a second air flow component, said first air flow component blown upwardly from said fan and directed toward said rearward air outlet, said second air flow component flowing along an upper edge of said hollow wall toward said rearward air outlet.

2. A fan device for a refrigerator comprising:

a hollow wall having a front wall portion and a rear wall portion for dividing an interior space of said refrigerator into a heat exchange zone and a first portion of a storage zone;

an air suction opening formed in said rear wall portion for allowing an air cooled in said heat exchanging zone to be induced into said hollow wall;

a fan disposed in alignment with said air suction opening so as to induce said cooled air;

a plurality of forward air outlet slots formed in said front wall portion for allowing said air in said hollow wall to be blown to said first portion; and a rearward air outlet formed in said rear wall portion at a side of said air suction opening for allowing said air in said hollow wall to be blown to a second portion of said storage zone through means for communicating said rearward air outlet to said second portion;

wherein a flow settling plate is disposed in said hollow wall at a position between said air suction opening and said rearward air outlet so as to separate a first air flow component and a second air flow component, said first air flow component blown upwardly from said fan and directed toward said rearward air outlet, said second air flow component being a circulation flow generated below said rearward air outlet and flowing adjacent to said first air flow component in a direction opposed to the flowing direction of said first air flow component.

* * * * *